US006329327B1

(12) United States Patent
Tanaka et al.

(10) Patent No.: US 6,329,327 B1
(45) Date of Patent: Dec. 11, 2001

(54) LUBRICANT AND LUBRICATING COMPOSITION

(75) Inventors: Noriyoshi Tanaka; Aritoshi Fukushima; Kazuhisa Morita; Atsuo Miyashita; Kazuhiro Umehara; Yoko Saito, all of Tokyo (JP)

(73) Assignee: Asahi Denka Kogyo, K.K., Tokyo (JP)

( * ) Notice: Subject to any disclaimer, the term of this patent is extended or adjusted under 35 U.S.C. 154(b) by 0 days.

(21) Appl. No.: 09/670,583

(22) Filed: Sep. 27, 2000

(30) Foreign Application Priority Data

Sep. 30, 1999 (JP) ..... 11-280468

(51) Int. Cl.[7] ..... C10M 139/00
(52) U.S. Cl. ..... 508/362; 508/371; 508/375
(58) Field of Search ..... 508/362

(56) References Cited

U.S. PATENT DOCUMENTS

| | | | | |
|---|---|---|---|---|
| 4,164,473 | * | 8/1979 | Coupland et al. | 508/362 |
| 4,261,843 | * | 4/1981 | King et al. | 508/362 |
| 4,266,945 | * | 5/1981 | Karn | 508/362 |
| 4,272,387 | * | 6/1981 | King et al. | 508/362 |
| 4,402,840 | * | 9/1983 | deVries et al. | 508/362 |
| 4,692,256 | * | 9/1987 | Umemura et al. | 508/362 |
| 5,716,913 | * | 2/1998 | Yamamoto et al. | 508/365 |
| 5,858,931 | * | 1/1999 | Tanaka et al. | 508/364 |

* cited by examiner

*Primary Examiner*—Ellen M. McAvoy
(74) *Attorney, Agent, or Firm*—Sughrue, Mion, Zinn, Macpeak & Seas, PLLC

(57) ABSTRACT

A lubricating composition containing an organic molybdenum compound having excellent oxidation stability that provides lubricity for long periods of time is provided.

The lubricant comprises a molybdenum amine compound obtained by reacting a compound containing a hexavalent molybdenum atom with an amine represented by the following formula (1):

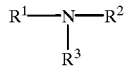

(1)

wherein each of $R^1$ to $R^3$ represents a hydrogen atom and/or a hydrocarbon group, and at least one of $R^1$ to $R^3$ is a chain hydrocarbon group having 14 or more carbon atoms;

or the following formula (2)

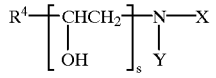

(2)

wherein $R^4$ represents a chain hydrocarbon group having 10 or more carbon atoms, s represents 0 or 1, X and/or Y represents a hydrogen atom, a hydrocarbon group, an alkanol group or an alkyl amino group having 2 to 4 carbon atoms, and X and Y are not hydrogen atoms or hydrocarbon groups at the same time when s is 0. A lubricating composition containing the lubricant is also provided.

6 Claims, No Drawings

LUBRICANT AND LUBRICATING COMPOSITION

BACKGROUND OF THE INVENTION

1. Field of the Invention

The present invention relates to a lubricant and to a lubricating composition.

2. Description of the Related Art

Recently, automobile regulations such as regulations regarding fuel consumption and exhaust emissions have become more and more severe. The reasons behind this are environmental problems such as global warming, air pollution, acid rain or the like, and protection of resources out of concern regarding depletion of finite petroleum energy resources. As a countermeasure, reducing fuel consumption is the most effective solution at present.

When reducing automobile fuel consumption, i.e., when improving fuel consumption, improvements in engine oil such as lowering engine oil viscosity in order to reduce engine friction loss, adding good friction regulators or the like are just as important as improvements in the automobile itself such as lightening automobile bodies, improvements in engines, etc. Although, engine oil acts as a lubricant between a piston and a liner, this is where there is a lot of hydrodynamic lubrication. Lowering engine oil viscosity can therefore decrease frictional losses. However, even though lowering engine oil viscosity has been proposed in recent years, lowering the viscosity of the lubricant causes problems such as defective sealing and increased wear. Engine oil plays an important role in lubricating valve train, bearings and the like where mixed lubrication and boundary lubrication are mostly employed. Therefore, lowering the viscosity of the engine oil causes increased wear. Friction modifiers, extreme pressure agents or the like are added thereto in order to decrease the friction loss and prevent the wear that accompanies a lowering of engine oil viscosity.

Generally, organic molybdenum compounds are added to different types of lubricant oil due to their excellent friction reducing properties. Such compounds are especially effective in engine oil for reducing fuel consumption, which makes them an essential additive for fuel consumption reducing oil. Even though fuel consumption reducing oil exhibits superior properties when new, this is not sufficient for superior fuel consumption reducing oil. Superior fuel consumption reducing oil must maintain fuel consumption reducing properties for long periods of time. Accordingly, an important characteristic for current fuel consumption reducing oil is whether the friction reducing effect can be maintained for a long period of time.

One of the organic molybdenum compounds is a molybdenum amine compound obtained by reacting an inorganic molybdenum compound such as molybdenum trioxide with a secondary amine as, for example, described in Japanese Patent Publications Nos. 5-62639, and 6-4866. In general, a secondary amine having a relatively short chain such as di(2-ethylhexyl)amine is widely used.

Through extensive research, the present inventors have discovered that a molybdenum compound having a relatively long hydrocarbon group has excellent oxidation stability and can maintain it for long periods of time upon being mixed into a lubricating base, and they have thus completed the invention.

SUMMARY OF THE INVENTION

The present invention provides a lubricant, comprising a molybdenum amine compound obtained by reacting a compound containing a hexavalent molybdenum atom with an amine represented by the following formula (1):

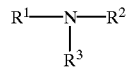

(1)

wherein each of $R^1$ to $R^3$ represents a hydrogen atom and/or a hydrocarbon group, and at least one of $R^1$ to $R^3$ is a chain hydrocarbon group having 14 or more carbon atoms;

or the following formula (2)

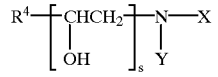

(2)

wherein $R^4$ represents a chain hydrocarbon group having 10 or more carbon atoms, s represents 0 or 1, X and/or Y represents a hydrogen atom, a hydrocarbon group, an alkanol group or an alkyl amino group having 2 to 4 carbon atoms, and both X and Y are not hydrogen atoms or hydrocarbon groups when s is 0.

DETAILED DESCRIPTION OF THE INVENTION

The lubricant of the present invention is a molybdenum amine compound obtained by reacting a compound containing a hexavalent molybdenum atom with a primary, secondary or tertiary amine represented by the formula (1) or the formula (2). Examples of the compound containing the hexavalent molybdenum atom include molybdenum trioxides or hydrates thereof ($MoO_3.nH_2O$), molybdenum acid ($H_2MoO_4$), alkali metal molybdates ($M_2MoO_4$) wherein M represents an alkali metal such as sodium and potassium, ammonium molybdates $\{(NH_4)_2MoO_4$ or $(NH_4)_6[Mo_7O_{24}].4H_2O\}$, $MoOCl_4$, $MoO_2Cl_2$, $MoO_2Br_2$, $Mo_2O_3Cl_6$ and the like. Molybdenum trioxides or hydrates thereof, molybdenum acid, alkali metal molybdates and ammonium molybdates are preferable because of their availability.

In the formula (1), each of $R^1$ to $R^3$ represents a hydrogen atom and/or a hydrocarbon group. At least one of the $R^1$ to $R^3$ is a chain hydrocarbon group having 14 or more carbon atoms. Examples of the chain hydrocarbon group include an alkyl group and an alkenyl group. Specific examples of the alkyl or alkenyl group having 14 or more carbon atoms include tetradecyl, secondary tetradecyl, tetradecenyl, hexadecyl, secondary hexadecyl, hexadecenyl, stearyl, oleyl, icocyl, dococyl, tetracocyl, hexacocyl, octacocyl, triacontyl, 2-butyldecyl, 2-hexyloctyl, 2-hexyldecyl, 2-octyldecyl, 2-hexyldodecyl, 2-octyldodecyl, 2-decyltetradecyl, 2-dodecylhexadecyl, 2-hexadecyloctadecyl, 2-tetradecyloctadecyl, monomethyl branched isostearyl and the like.

Specific examples of the amine represented by the formula (1) include monoalkyl (or alkenyl) amines such as tetradecylamine, stearylamine, oleylamine, beef tallow alkylamine, hardened beef tallow alkylamine, and soybean oil alkylamine; dialkyl(or alkenyl)amines such as N-tetradecylmethylamine, N-pentadecylmethylamine, N-hexadecylmethylamine, N-stearylmethylamine, N-oleylmethylamine, N-dococylmethylamine, N-beef tallow alkyl methylamine, N-hardened beef tallow alkyl methylamine, N-soybean oil alkyl methylamine, ditetradecylamine, dipentadecylaimne, dihexadecylamine, distearylamine, dioleylamine, didococylamine, bis(2-hexyldecyl)amine, bis(2-octyldodecyl)amine, bis(2-decyltetradecyl)amine, beef tallow dialkylamine, hardened beef tallow dialkylamine, and soybean oil dialkylamine; and trialkyl(or alkenyl)amines such as tetradecyldimethylamine, hexadecyldimethylamine, octadecyldimethylamine, beef tallow alkyldimethylamine, hardened beef tallow alkyldimethylamine, soybean oil alkyldimethylamine, dioleylmethylamine, tritetradecylamine, tristearylamine, and trioleylamine. Among these amines represented by the formula (1), secondary amines having two alkyl (or alkenyl) groups with 14 to 18 carbon atoms are preferable.

In the formula (2), $R^4$ represents a chain hydrocarbon group having 10 or more carbon atoms. Examples of the chain hydrocarbon group having 10 or more carbon atoms include an alkyl group having 10 to 13 carbon atoms such as decyl, secondary decyl, undecyl, secondary undecyl, dodecyl, secondary dodecyl, tridecyl, isotridecyl, and secondary tridecyl other than the alkyl or alkenyl groups having 14 or more carbon atoms as described above.

In the formula (2), s represents 0 or 1.

X and/or Y represent a hydrogen atom, a hydrocarbon group having at least one carbon atom, an alkanol group having 2 to 4 carbon atoms or an alkyl amino. Examples of the alkanol group having 2 to 4 carbon atoms include an ethanol group, an isopropanol group, a 2-butanol group, a 1-methyl-2-propanol group, a 2-methyl-2-propanol. The alkylamino group is represented by the following formula (4):

$$-[(CH_2)_aNM]_bM \quad (4)$$

wherein a represents 2 to 6, b represents 1 or more, and M represents a hydrogen atom, a hydrocarbon group, or an alkanol group having 2 to 4 carbon atoms. In the formula (2), when s is 0, X and Y are not hydrogen atoms or hydrocarbon groups at the same time.

When s is 1, examples of the amine represented by the formula (2) include primary amines such as 2-hydroxydodecylamine, 2-hydroxytetradecylamine, 2-hydroxyhexadecylamine, 2-hydroxyoctadecylamine, and 2-hydroxyeicocylamine; secondary amines such as N-2-hydroxydodecylmethylamine, N-2-hydroxytetradecylmethylamine, N-2-hydroxyhexadecylmethylaimne, N-2-hydroxyoctadecylmethylamine, N-2-hydroxyeicocylmethylamine, N-2-hydroxydodecylethylamine, N-2-hydroxydodecylbutylamine, N-2-hydroxydodecylethanolamine, N-2-hydroxytetradecylethanolamine, N-2-hydroxyhexadecylethanolamine, N-2-hydroxyoctadecylethanolamine, and N-2-hydroxyeicocyletanolamine; tertiary amines such as N-2-hydroxydodecyldimethylamine, N-2-hydroxytetradecyldimethylamine, N-2-hydroxyhexadecyldimethylamine, N-2-hydroxyoctadecyldimentylamine, N-2-hydroxyeicocyldimethylamine, N-2-hydroxydodecyldiethylamine, N-2-hydroxytetradecyldiethylamine, N-2-hydroxydodecyldibutylamine, N-2-hydroxydodecyldiethanolamine, N-2-hydroxytetradecyldiethanolamine, N-2-hydroxyhexadecyldiethanolamine, N-2-hydroxyoctadecyldiethanolamine, N-2-hydroxyeicocyldiethanolamine, and N-2-hydroxydodecyldiisopropanolamine; N-2-hydroxyoctadecyl(aminoethyl)amine; and N-2-hydroxyoctadecylbis(2-aminoethyl)amine. Among those amines represented by the formula (2) when s is 1, the secondary amines having $R^4$ with 10 to 16 carbon atoms are preferred.

When s is 0, examples of the amine represented by the formula (2) include ethanolamines such as N-decylethanolamine, N-dodecylethanolamine, N-isotridecylethanolamine, N-tetradecylethanolamine, N-hexadecylethanolamine, N-octadecylethanolamine, N-oleylethanolamine, N-decyldiethanolamine, N-dodecyldiethanolamine, N-isotridecyldiethanolamine, N-tetradecyldiethanolamine, N-hexadecyldiethanolamine, N-octadecyldiethanoamine, N-oleyldiethanolamine, N-behenyldiethanolamine, N,N-didecylethanolamine, N,N-didodecylethanolamine, N,N-diisotridecyldiethanolamine, N,N-ditetradecylethanolamine, N,N-dihexsadecylethanolamine, N,N-dioctadecylethanolamine, N,N-dibehenylethanolamine, and N,N-dioleylethanolamine; isopropanolamines such as N-decyldiisopropanolamine, N-dodecyldiisopropanolamine, N-isotridecyldiisopropanolamine, N-tetradecyldiisopropanolamine, N-hexadecyldiisopropanolamine, N-octadecyldiisopropanolamine, N-oleyldiisopropanolamine, N,N-didecylisopropanolamine, N,N-didodecylisopropanolamine, N,N-diisotridecylisopropanolamine, N,N-ditetradecylisopropanolamine, N,N-dihexadecylisopropanolamine, N,N-dioctadecylisopropanolamine, and N,N-dioleylisopropanolamine; 2-butanolamines such as N-decylbis(2-butanol)amine, N-dodecylbis(2-butanol)amine, N-isotridecylbis(2-butanol)amine, N-tetradecylbis(2-butanol)amine, N-hexadecylbis(2-butanol)amine, N-octadecylbis(2-butanol)amine, N-oleylbis(2-butanol)amine, N,N-didecyl-2-butanolamine, N,N-didocyl-2-buthanolamine, N,N-diisotridecyl-2-butanolamine, N,N-ditetradecyl-2-butanolamine, N,N-dihexadecyl-2-butanolamine, N,N-dioctadecyl-2-butanolamine, and N,N-dioleyl-2-butanolamine; and 1,3-propanediamines and ethylene oxide adducts thereof such as N-decyl-1,3-propanediamine, N-dodecyl-1,3-propanediamine, N-isotridecyl-1,3-propanediamine, N-tetradecyl-1,3-propanediamine, N-octadecyl-1,3-propanediamine and 3-molar ethylene oxide adducts of N-octadecyl-1,3-propanediamine. Among those amines represented by the formula (2) when s is 0, the ethanolamines or diethanolamine having $R^4$ with 10 to 18 carbon atoms, and 1,3-propanediamines are preferred.

The molybdenum amine compound is a salt of a compound containing a hexavalent molybdenum atom such as molybdenum trioxide, molybdic acid ($H_2MoO_4$), and molybdenate, with primary to tertiary amines, and can be obtained by reacting the hexavalent molybdenum compound with the amine represented by the formula (1) or (2) at a temperature between room temperature and 150° C., as described in Japanese Patent Laid-open No. 61-285293.

The molybdenum amine compound according to the present invention is obtained by reacting the molybdenum compound with the amine having a chain hydrocarbon group with 14 or more carbon atoms represented by the formula (1) or the amine having a chain hydrocarbon group with 10 or more carbon atoms represented by the formula (2), and provides excellent friction reducing effects for long periods of time as compared with that of a lubricant including a molybdenum amine compound obtained by reacting the molybdenum compound with an amine having a small number of carbon atoms.

Although the amount of the lubricant of the present invention added to the lubricating base is not especially limited, too small an amount will result in an insufficient friction reducing effect, and too large an amount may result in sludge production and corrosion. It is commonly believed that a relatively small amount of the molybdenum compound produces wear resistance, and a relatively large amount of the same apparently produces a friction reducing effect. Accordingly, in the case in which the lubricating base is a lubricating base oil, the amount of the molybdenum amine compound is preferably 0.01 to 10% by weight, more preferably 0.05 to 5% by weight, and most preferably 0.1 to 2% by weight based on the lubricating base oil. In the case in which the lubricating base is a lubricating base grease, the amount of the molybdenum amine compound is preferably 0.1 to 20% by weight, more preferably 0.5 to 15% by weight, and most preferably 1 to 10% by weight based on the lubricating base grease.

Blending zinc dithiophosphate represented by the formula (3) with the lubricant of the present invention further enhances antioxidation and long draining properties.

(3)

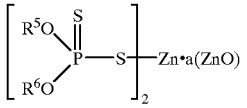

In the formula (3), each of $R^5$ and $R^6$ represents a hydrocarbon group. Each of $r^5$ and $R^6$ is preferably an alkyl group, an alkenyl group, an aryl group and the like. More preferably, each of $R^5$ and $R^6$ is an alkyl group having 3 to 14 carbon atoms. Two or more zinc dithiophosphates having different $R^5$ and $R^6$ may be used. In the formula (3), a represents 0 to 1/3. When a is 0, the component is referred to as neutral zinc dithiophosphate, and when a is 1/3, the component is referred to as basic zinc dithiophosphate.

Although the amount of the zinc dithiophosphate is not especially limited, a certain amount of zinc dithiophosphate is preferable in order to yield practical friction reduction and antioxidation effects. However, too much zinc dithiophosphate may produce sludge. Accordingly, in the case in which the lubricating base is a base oil, the amount of the zinc dithiophosphate is preferably 0.001 to 3% by weight, more preferably 0.005 to 2% by weight, and most preferably 0.01 to 1% by weight calculated in terms of the amount of phosphorus based on the lubricating base oil. In the case in which the lubricating base is a base grease, the amount of the zinc dithiophosphate is preferably 0.01 to 10% by weight, more preferably 0.03 to 7% by weight, and most preferably 0.05 to 5% by weight calculated in terms of the amount of phosphorus based on the lubricating base grease.

Depending on the application, the lubricant of the present invention can include any one or more of a metal detergent (D1), an ashless dispersant (D2), a compound containing at least one phosphorus atom (D3), a compound containing a phosphorus atom and a sulfur atom (D4), a compound containing a sulfur atom and no metal atoms (D5), an antioxidant (D6), an organic metal compound (D7), an oiliness improver containing no metal atoms, phosphorus atoms or sulfur atoms (D8), an inhibitor (D9), a viscosity index improver (D10), a metal deactivating agent (D11), an antifoaming agent (D12), and a solid lubricant (D13).

Examples of the metal detergent (D1) include metal sulphonates, metal phenates, metal salicylates, metal phosphonates and the like. Examples of the metal sulphonates include (mono- or di-)alkylbenzene metal sulphonates, (mono- or di-)alkylnaphthalene metal sulphonates, petroleum metal sulphonates and the like. Examples of the metal phenates include (mono- or di-)alkylphenol metal salts, thiobis{(mono- or di-)alkylphenol}metal salts, methylenebis{mono- or di-}alkylphenol}metal salts and the like. Examples of the metal salicylates include (mono- or di-)alkyl metal salicylates, thiobis{(mono- or di-)alkyl salicylate}metal salts, methylenebis{(mono- or di-)alkyl salicylate}metal salts and the like.

The metal atom is preferably an alkali metal or alkaline earth metal, and more preferably is calcium, magnesium, or barium.

The above-described compounds are generally referred to as neutral salts. Basic or overbased metal detergents that are obtained by blowing carbon dioxide thereinto and subjecting a base treatment with metal oxides or metal hydroxides are preferably used. The overbased products are typically contained in the form of carbonate. Total Base Numbers (TBN) of these basic or overbased metal detergents generally range from 200 to 500 mgKOH/g.

Among these metal detergents, most preferred is neutral, basic, or overbased calcium salicylate or calcium sulphonate. The amount of the component (D1) is approximately 0.5 to 15% by weight based on the lubricating base.

Examples of ashless dispersants (D2) include succinimide, benzylamine, succinate esters, boron compounds thereof and the like. The succinimide compound herein preferably has a molecular weight of 300 to 4,000. Examples of the succinimide compound include a monoimide or a bisimide of succinic acid having a polyalkenyl group such as polybutenyl with a polyethyleneamine such as ethylenediamine, diethylenetriamine, triethylenetetramine, tetraethylenepentamine, and pentaethylenehexamine, or boron compounds thereof; and a Mannich reaction product of phenol having a polyalkenyl group, with formaldehyde, and polyethyleneamine.

Nitrogen content of the ashless dispersant is typically 0.5 to 2.0% by weight. The most preferred ashless dispersant is succinimide or boron compounds thereof. The amount of the (D2) component is preferably 0.5 to 20% by weight based on the lubricating base.

Examples of the compound containing a phosphorus atom (D3) include organic phosphorus compounds such as phosphines, phosphine oxides, phosphinites, phosphonites, phosphinates, phosphites, phosphonates, phosphates and phosphoroamidates.

These compounds mainly improve lubricity, wear resistance and the like, and may also act as antioxidants.

Examples of the organic phosphines represented by $(R)_3P$ include tributylphosphine, trihexylphosphine, trioctylphosphin, tri(2-ethylhexyl)phosphine, trinonylphosphine, tridecylphosphine, trilaurylphosphine, trimyristylphosphine, tripalmitylphosphine, tristearylphosphin, trioleylphosphine, triphenylphosphine, tricresylphosphine and the like.

Examples of alkylidene bisphosphines represented by $(R)_2P—(CH_2)_n—P(R)_2$ include methylenebis(dibutylphosphine), methylenebis(dihexylphosphine), methylenebis(dioctylphosphine), methylenebis(di2-ethylhexylphosphine), methylenebis(dinonylphosphine), methylenebis(didecylphosphin), methylenebis(dilauryphosphine), methylenebis(dimyristylphosphine), methylenebis(dipalmitylphosphine), methylenebis (distearyphosphine), methylenebis(dioleylphosphine), methylenebis(diphenylphosphin), methylenebis (dicresylphosphine) and the like.

Examples of the organic phosphine oxides represented by $(R)_3P{=}O$ include tributylphosphine oxide, trihexylphosphine oxide, trioctylphosphine oxide, tri(2-ethylhexyl) phosphine oxide, trinonylphosphine oxide, tridecylphosphine oxide, trilaurylphosphine oxide, trimyristylphosphine oxide, tripalmitylphosphine oxide, tristearylphosphine oxide, trioleylphosphine oxide, triphenylphosphine oxide, tricresylphosphine oxide and the like.

Examples of the organic phosphites represented by $(RO)_3P$ include mono, di, or tri-butyl phosphite (hereinafter "mono, di, or tri" is referred to as "mono/di/tri"), mono/di/trihexyl phosphite, mono/di/trioctyl phosphite, mono/di/tri (2-ethylhexyl)phosphite, mono/di/trinonyl phosphite, mono/di/tridecyl phosphite, mono/di/trilauryl phosphite, mono/di/trimyristyl phosphite, mono/di/tripalmityl phosphite, mono/di/tristearyl phosphite, mono/di/trioleyl phosphite, mono/di/triphenyl phosphite, mono/di/tricresyl phosphite and the like. Other phosphites include pentaerythritol diphosphite, pentaerythritol tetraphosphite, alkylidene bisphosphite and the like.

Examples of the organic phosphates represented by $(RO)_3P{=}O$ include mono/di/tri-butyl phosphate, mono/di/trihexyl phosphate, mono/di/trioctyl phosphate, mono/di/tri (2-ethylhexyl)phosphate, mono/di/trinonyl phosphate, mono/di/tridecyl phosphate, mono/di/trilauryl phosphate, mono/di/trimyristyl phosphate, mono/di/tripalmityl phosphate, mono/di/tristearyl phosphate, mono/di/trioleyl phosphate, mono/di/triphenyl phosphate, mono/di/tricresyl phosphate and the like. It may also include a phosphate having a polyoxyalkylene group, i.e., phosphate of lauryl alcohol ethylene oxide and/or propylene oxide adducts and the like.

The mono- or di-phosphates are referred to as acidic phosphate esters and may be used by neutralizing with bases such as alkalis, amines and the like. Examples of alkalis include metal hydroxides such as lithium hydroxide, sodium hydroxide, potassium hydroxide, magnesium hydroxide, calcium hydroxide and the like. Examples of amines include ammonia; alkylamines such as methylamine, dimethylamine, ethylamine, diethylamine, (iso) propylamine, di(iso)propylamine, butylamine, hexylamine, octylamine, decylamine, dodecylamine, tridecylamine, cetylamine, coco alkylamine, soybean oil alkylamine, beef tallow alkylamine, oleylamine, stearylamine and the like; alkanolamines such as monoethanolamine, N-methyl monoethanolamine, N-ethyl monoethanolamine, diethanolamine, N-methyl diethanolamine, N-ethyl diethanolamine, triethanolamine, 2-amino-2-methyl-1-propanol, 2-amino-2-methyl-1,3-propandiol, aminoethyl ethanolamine, N,N,N',N'-tetrakis(hydroxyethyl) ethylenediamine, N,N,N',N'-tetrakis(2-hydroxypropyl) ethylenediamine and the like and alkylene oxide adducts thereof; N-long chain alkylalkanolamines such as N-butyl diethanolamine, N-hexyl diethanolamine, N-octyl diethanolamine, N-decyl diethanolamine, N-cocoylalkyl diethanolamine, N-soybean oil alkyl diethanolamine, N-beef tallow alkyl diethanolamine, N-oleyl diethanolamine, N-stearyl diethanolamine, N,N-dibutyl monoethanolamine, N,N-dihexyl monoethanolamine, N,N-dioctyl monoethanolamine, N,N-didecyl monoethanolamine, N,N-bis(cocoylalkyl)monoethanolamine, N,N-bis(soybean oil alkyl)monoethanolamine, N,N-bis(beef tallow alkyl) monoethanolamine, N-dioleyl monoethanolamine, N-distearyl monoethanolamine and the like and alkylene oxide adducts thereof. Examples of the phosphoroamidates include condensation products of the phosphates listed above and the amines listed above and the like.

The amount of the component (D3) is preferably about 0.1 to 10% by weight based on the lubricating base.

Examples of the compound containing a phosphorus atom and a sulfur atom (D4) include trithiophsphite, thiophosphate and the like. These compounds enhance mainly lubricity, wear resistance and the like, and may also act as antioxidants.

Examples of the organic trithiophosphites represented by $(RS)_3P$ and the like include mono/di/tributyl trithiophosphite, mono/di/trihexyl trithiophosphite, mono/di/trioctyl trithiophosphite, mono/di/tri(2-ethylhexyl) trithiophosphite, mono/di/trinonyl trithiophosphite, mono/di/tridecyl trithiophosphite, mono/di/trilauryl trithiophosphite, mono/di/trimyristyl trithiophosphite, mono/di/tripalmityl trithiophosphite, mono/di/tristearyl trithiophosphite, mono/di/trioleyl trithiophosphite, mono/di/triphenyl trithiophosphite, mono/di/tricresyl trithiophosphite and the like.

Examples of the organic thiophosphates represented by $(RO)_3P{=}S$ include mono/di/tributyl thiophosphate, mono/di/trihexyl thiophosphate, mono/di/trioctyl thiophosphate, mono/di/tri(2-ethylhexyl)thiophosphate, mono/di/trinonyl thiophosphate, mono/di/tridecyl thiophosphate, mono/di/trilauryl thiophosphate, mono/di/trimyristyl thiophosphate, mono/di/tripalmityl thiophosphate, mono/di/tristearyl thiophosphate, mono/di/trioleyl thiophosphate, mono/di/triphenyl thiophosphate, mono/di/tricresyl thiophosphate and the like.

Dithiophosphoric acid dimers may also be used.

The amount of the component (D4) is preferably about 0.1 to 10% by weight based on the lubricating bases.

Examples of the compound containing a sulfur atom and no metal atoms (D5) include those where double bonds in fat and oil compounds are sulfurized such as sulfurized lard, sulfurized fish oil, sulfurized whale oil, sulfurized soybean oil, sulfurized pinene oil, sulfurized sperm oil, sulfurized fatty acid; sulfur alone; organic mono- or poly-sulfide; sulfurized polyolefin such as isobutylene; 1,3,4-thiadiazol derivatives; thiuram disulfide; dithiocarbamate ester and the like.

The organic mono- or poly-sulfide is a compound represented by the following formula (D5-1):

$$R{-}S_x{-}R \qquad \text{(D5-1)}$$

and includes dihydrocarbyl sulfides such as dimethyl mono/di/polysulfide, diethyl mono/di/polysulfide, dipropyl mono/di/polysulfide, diisopropyl mono/di/polysulfide, dibutyl mono/di/polysulfide, diisobutyl mono/di/polysulfide, ditertiarybutyl mono/di/polysulfide, dipentyl mono/di/polysulfide, diisopentyl mono/di/polysulfide, dineopentyl mono/di/polysulfide, ditertiarypentyl mono/di/polysulfide, dihexyl mono/di/polysulfide, diheptyl mono/di/polysulfide, dioctyl mono/di/polysulfide, di2-ethylhexyl mono/di/polysulfide, dinonyl mono/di/polysulfide, ditertiarynonyl mono/di/polysulfide, didecyl mono/di/polysulfide, diundecyl mono/di/polysulfide, didodecyl mono/di/polysulfide, ditridecyl mono/di/polysulfide, diisotridecyl mono/di/polysulfide, ditetradecyl mono/di/polysulfide, dihexadecyl mono/di/polysulfide, distearyl mono/di/polysulfide, diisostearyl mono/di/polysulfide, dioleyl mono/di/polysulfide, diicocyl mono/di/polysulfide, didococyl mono/di/polysulfide, ditetracocyl mono/di/polysulfide, ditriacontyl mono/di/polysulfide, diphenyl mono/di/polysulfide, ditoluyl mono/di/polysulfide, dixylyl mono/di/polysulfide, dicumenyl mono/di/polysulfide, dimethycyl mono/di/polysulfide, dibenzyl mono/di/polysulfide, diphenetyl mono/di/polysulfide, distyryl mono/di/polysulfide, dicynnamyl mono/di/polysulfide, dibenzhydryl mono/di/polysulfide, ditrytyl mono/di/polysulfide, di(ethylphenyl)mono/di/polysulfide, di(propylphenyl)mono/di/polysulfide, di(butylphenyl)mono/di/polysulfide, di(pentylphenyl)mono/di/polysulfide, di(hexylphenyl)mono/di/polysulfide, di(heptylphenyl)mono/di/polysulfide, di(octylphenyl)mono/di/polysulfide, di(nonylphenyl)mono/di/polysulfide, di(decylphenyl)mono/di/polysulfide, di(undecylphenyl)mono/di/polysulfide, di(dodecylphenyl)mono/di/polysulfide, di(phenylphenyl)mono/di/polysulfide, di(benzylphenyl)mono/di/polysulfide, di(stylenatedphenyl)mono/di/polysulfide, di(p-cumylphenyl)mono/di/polysulfide, dicyclopentyl mono/di/polysulfide, dicyclohexyl mono/di/polysulfide, dicycloheptyl mono/di/polysulfide, dimethylcyclopentyl mono/di/polysulfide, dimethylcyclohexyl mono/di/polysulfide, dimethylcycloheptyl mono/di/polysulfide and the like; dihydrocarbylphenol sulfides such as di(ethylhydroxyphenyl)mono/di/polysulfide, di(propylhydroxyphenyl)mono/di/polysulfide, di(butylhydroxyphenyl)mono/di/polysulfide, di(pentylhydroxyphenyl)mono/di/polysulfide, di(hexylhydroxyphenyl)mono/di/polysulfide, di(heptylhydroxyphenyl)mono/di/polysulfide, di(octylhydroxyphenyl)mono/di/polysulfide, di(nonylhydroxyphenyl)mono/di/polysulfide, di(decylhydroxyphenyl)mono/di/polysulfide, di(undecylhydroxyphenyl)mono/di/polysulfide, di(dodecylhydroxyphenyl)mono/di/polysulfide and the like.

The 1,3,4-thiadiazol derivative is represented by the following formula (D5-2):

(D5-2)

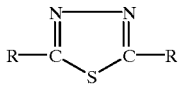

[wherein R represents a hydrocarbon group or a hydrocarbon group containing a sulfur atom].

Examples of the hydrocarbon group containing a sulfur atom include 5-thianonyl, 2,5-dithianonyl, 3,4-dithiahexyl, 4,5-dithiahexyl, 3,4,5-trithiaheptyl, 3,4,5,6-tetrathiaoctyl, 5-thia-2-heptenyl, 4-thiacyclohexyl, 1,4-dithianaphtyl, 5-(methylthio)octyl, 4-(ethylthio)-2-pentenyl, 4-(methylthio)cyclohexyl, 4-mercaptophenyl, 4-(methylthio)phenyl, 4-(hexylthio)benzyl, stearyldithio, lauryldithio, octyldithio, stearylthio, laurylthio, octylthio, N,N-dialkyldithiocarbamoyl and the like, most preferably the group where 2 to 4 sulfur atoms are combined continuously.

The thiuram disulfide is represented by the following formula (D5-3)

(D5-3)

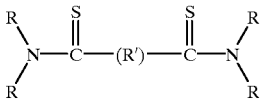

[wherein R represents a hydrocarbon group, and R' represents a sulfur atom, a divalent hydrocarbon group or a divalent hydrocarbon group containing a sulfur atom].

Examples of the R' include a group represented by —S(—S)$_n$— [wherein n is 0 or 1 or more], a methylene group, a group represented by —S(—S)$_n$(—CH$_2$)$_n$—S(—S)$_n$— [wherein each n is 0 or 1 or more and may be the same or different] and the like. R is preferably a linear hydrocarbon group having 4 or more carbon atoms.

The dithiocarbamate ester is represented by the following formula (D5-4):

(D5-4)

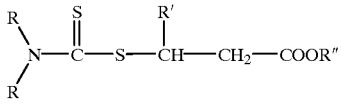

[wherein R represents a hydrocarbon group, R' represents hydrogen, a hydrocarbon group or a group represented by COOR" and R" represents a hydrocarbon group].

The amount of the component (D5) is preferably about 0.1 to 15% by weight based on the lubricating base.

The antioxidant (D6) includes a phenol-based antioxidant, an amine-based antioxidant, a sulfur-based antioxidant and the like.

Examples of the phenol-based antioxidant include 2,6-di-tert-butylphenol (hereinafter "tert-butyl" is referred to as "t-butyl"), 2,6-di-t-butyl-p-cresol, 2,6-di-t-butyl-4-methylphenol, 2,6-di-t-butyl-4-ethylphenol, 2,4-dimethyl-6-t-butylphenol, 4,4'-methylenebis(2,6-di-t-butylphenol), 4,4'-bis(2,6-di-t-butylphenol), 4,4'-bis(2-methyl-6-t-butylphenol), 2,2'-methylenebis(4-methyl-6-t-butylphenol), 2,2'-methylenebis(4-ethyl-6-t-butylphenol), 4,4'-butylidenebis(3-methyl-6-t-butylphenol), 4,4'-isopropilidenbis(2,6-di-t-butylphenol), 2,2'-methylenebis(4-methyl-6-cyclohexylphenol), 2,2'-methylenebis(4-methyl-6-nonylphenol), 2,2'-isobutylidenebis(4,6-dimethylphenol), 2,6-bis(2'-hydroxy-3'-t-butyl-5'-methylbenzyl)-4-methylphenol, 3-t-butyl-4-hydroxy anisole, 2-t-butyl-4-hydroxy anisole, 3-(4-hydroxy-3,5-di-t-butylphenyl)stearyl propionate, 3-(4-hydroxy-3,5-di-t-butylphenyl)oleyl propionate, 3-(4-hydroxy-3,5-di-t-butylphenyl)dodecyl propionate, 3-(4-hydroxy-3,5-di-t-butylphenyl)decyl propionate, 3-(4-hydroxy-3,5-di-t-butylphenyl)octyl propionate, tetrakis{3-(4-hydroxy-3,5 -di-t-butylphenyl) propionyloxymethyl} methane, 3-(4-hydroxy-3,5-di-t-butylphenyl)glycerin propionate monoester, an ester of 3-(4-hydroxy-3,5-di-t-butylphenyl)propionate and glycerin monooleyl ether, 3-(4-hydroxy-3,5-di-t-butylphenyl) butylene propionate glycolate ester, 3-(4-hydroxy-3,5-di-t-butylphenyl)propionate thiodiglycolate ester, 4,4'-thiobis(3-methyl-6-t-butylphenol), 4,4'-thiobis(2-methyl-6-t-butylphenol), 2,2'-thiobis(4-methyl-6-t-butylphenol), 2,6-di-t-butyl-α-dimethylamino-p-cresol, 2,6-di-t-butyl-4-(N,N'-dimethylaminomethylphenol), bis(3,5-di-t-butyl-4-hydroxy benzyl)sulfide, tris{(3,5-di-t-butyl-4-hydroxyphenyl)propionyl-oxyethyl}isocyanulate, tris(3,5-di-t-butyl-4-hydroxyphenyl)isocyanulate, 1,3,5-tris(3,5-di-t-butyl-4-hydroxybenzyl)isocyanulate, bis{2-methyl-4-(3-n-alkylthiopropionyloxy)-5-t-butylphenyl}sulfide, 1,3,5-tris(4-t-butyl-3-3hydroxy-2,6-dimethylbenzyl)isocyanulate, tetraphthaloyl-di(2,6-dimethyl-4-t-butyl-3-hydroxybenzyl sulfide), 6-(4-hydroxy-3,5-di-t-butylanilino)-2,4-bis(octylthio)-1,3,5-triazine, 2,2-thio-{diethyl-bis-3-(3,5-di-t-butyl-4-hydroxyphenyl)}propionate, N,N'-hexamethylenebis(3,5-di-t-butyl-4-hydroxy-hydrocinnamido), 3,5-di-t-butyl-4-hydroxy-benzyl-phosphate diester, bis(3-methyl-4-hydroxy-5-t-butylbenzyl) sulfide, 3,9-bis[1,1-dimethyl-2-{β-(3-t-butyl-4-hydroxy-5-methylphenyl)propionyloxy}ethyl]-2,4,8,10 -tetraoxaspiro[5,5]undecane, 1,1,3-tris(2-methyl-4-hydroxy-5-t-butylphenyl)butane, 1,3,5-trimethyl-2,4,6-tris(3,5-di-t-butyl-4-hydroxybenzyl)benzene, bis{3,3'-bis-(4'-hydroxy-3'-t-butylphenyl)butylic acid}glycolate ester and the like.

Examples of the amine-based antioxidant include naphthylamine-based antioxidants such as 1-naphthylamine, phenyl-1-naphthylamine, p-octylphenyl-1-naphthylamine, p-nonylphenyl-1-naphthylamine, p-dodecylphenyl-1-naphthylamine, phenyl-2-naphthylamine and the like; phenylenediamine-based antioxidants such as N,N'-diisopropyl-p-phenylenediamine, N,N'-diisobutyl-p-phenylenediamine, N,N'-diphenyl-p-phenylenediamine, N,N'-di-β-naphtyl-p-phenylenediamine, N-phenyl-N'-isopropyl-p-phenylenediamine, N-cyclohexyl-N'-phenyl-p-phenylenediamine, N-1,3-dimethylbutyl-N'-phenyl-p-phenylenediamine, dioctyl-p-phenylenediamine, phenylhexyl-p-phenylenediamine, phenyloctyl-p-phenylenediamine and the like; diphenylamine-based antioxidants such as dipyridylamine, diphenylamine, p,p'-di-n-butylphenylamine, p,p'-di-t-butyldiphenylamine, p,p'-di-t-pentyldiphenylamine, p,p'-dioctyldiphenylamine, p,p'-dinonyldiphenylamine, p,p'-didecyldiphenylamine, p,p'-didodecyldiphenylamine, p,p'-distyryldiphenylamine, p,p'-dimethoxydiphenylamine, 4,4'-bis(4-α,α-dimethylbenzoyl) diphenylamine, p-isopropoxydiphenylamine, dipyridylamine and the like; and phenothiazine-based antioxidants such as phenothiazine, N-methylphenothiazine, N-ethylphenothiazine, 3,7-dioctylphenothiazine, phenothiazine carboxylate ester, and phenoselenazine.

Examples of the sulfur-based antioxidant include dioctylthiodipropionate, didecylthiodipropionate, dilaurylthiodipropionate, dimyristylthiodipropionate, distearylthiodipropionate, laurylstearylthiodipropionate, dimyristylthiodipropionate, distearyl-β,β'-thiodibutylate, (3-octylthiopropionic acid)pentaerythritol tetraester, (3-decylthiopropionic acid)pentaerythritol tetraester, (3-laurylthiopropionic acid)pentaerythritol tetraester, (3-stearylthiopropionic acid)pentaerythritol tetraester, (3-oleylthiopropionic acid)pentaerythritol tetraester, (3-laurylthiopropionic acid)-4,4-thiodi(3-methyl-5-t-butyl-4-phenol)ester, 2-mercaptobenzimidazole, 2-mercaptomethylbenzimidazol, 2-benzimidazoldisulfide, dilaurylsulfide, amylthioglycolate and the like.

In the case in which the lubricating base is a lubricating base oil, the amount of the component (D6) is preferably 0.05 to 10% by weight, more preferably 0.1 to 5% by weight, and most preferably 0.1 to 2% by weight based on the lubricating base oil. In the case in which the lubricating base is a lubricating base grease, the amount of the component (D6) is preferably 0.1 to 15% by weight, more preferably 0.1 to 10% by weight, and most preferably 0.5 to 5% by weight based on the lubricating base grease.

The organic metal compound (D7) enhances wear resistance and antioxidation properties. Examples of the organic metal compound (D7) include salts of lithium, sodium, potassium, magnesium, calcium, barium, titanium, zinc, lead, tin, iron, cadmium, cobalt, nickel, manganese, strontium, titanium, vanadium, copper, antimony, bismuth and tungsten with fatty acids or naphthenic acids such as hexanoic acid, octanoic acid, pelargonic acid, decanoic acid, lauric acid, myristic acid, palmitic acid, stearic acid, oleic acid, behenic acid, linolenic acid and linolenic acid. The fatty acids preferably contain about 12 to 18 carbon atoms.

Also the organic metal compound (D7) further includes dithiophosphoric acid metal salts, dithiocarbamic acid metal salts, mercaptobenzothiazole metal salts, mercaptobenzimidazole metal salts, benzamidothiophenol metal salts and the like. The metal atoms are described above. Molybdenum oxysulfide dithiocarbamate and molybdenum oxysulfide dithiophosphate may be used.

The amount of the component (D7) is preferably 0.01 to 20% by weight based on the lubricating base.

The component (D8) is an oiliness improver containing no metal atoms, phosphorus atoms, or sulfur atoms. Examples of the component (D8) include fatty acids such as hexanoic acid, octanoic acid, pelargonic acid, decanoic acid, lauric acid, myristic acid, palmitic acid, stearic acid, oleic acid, behenic acid, linolenic acid and linolenic acid; fats and oils such as linseed oil, perilla oil, oiticica oil, olive oil, cacao butter, kapok oil, white mustard oil, sesame oil, rice bran oil, safflower oil, shea nut oil, chinese wood oil, soybean oil, tea seed oil, tsubaki oil, corn oil, rape seed oil, palm oil, palm kernel oil, caster oil, sunflower oil, cotton seed oil, coconut oil, vegetable wax, peanut oil, horse tallow, beef tallow, hoof oil, ghee, lard, goat tallow, mutton tallow, milk fat, fish oil, whale oil and the like and hydrogenates or partially saponified variations thereof; epoxydated oils such as epoxydated soybean oil, epoxydated linseed oil and the like; epoxydated esters such as epoxy butyl stearate, epoxy octyl stearate and the like; dibasic acids such as glutaric acid, adipic acid, pimelic acid, suberic acid, azelaic acid, sebacic acid, dodecandioic acid, dimer acid and the like; polycondensed hydroxy stearates such as ricinoleic acid (caster oil fatty acid), 12-hydroxy stearic acid and the like or esters of the polycondensed products and fatty acids; higher alcohols such as lauryl alcohol, myristyl alcohol, palmityl alcohol, stearyl alcohol, oleyl alcohol, behenyl alcohol; higher amines such as lauryl amine, myristyl amine, palmityl amine, stearyl amine, oleyl amine, behenyl amine and the like; higher amides such as lauryl amide, myristyl amide, palmityl amide, stearyl amide, oleyl amide, behenyl amide and the like; diethanol amides such as lauryl diethanol amide, myristyl diethanol amide, palmityl diethanol amide, stearyl diethanol amide, oleyl diethanol amide, behenyl diethanol amide and the like; glycerides such as hexanoic acid mono/di/triglyceride, octanoic acid mono/di/triglyceride, decanoic acid mono/di/triglyceride, lauric acid mono/di/triglyceride, myristic acid mono/di/triglyceride, palmitic acid mono/di/triglyceride, stearic acid mono/di/triglyceride, oleic acid mono/di/triglyceride, behenic acid mono/di/triglyceride and the like; polyglycerin esters such as polyglycerin hexanoate ester, polyglycerin octanoate ester, polyglycerin decanoate ester, polyglycerin laurate ester, polyglycerin myristate ester, polyglycerin palmitate ester, polyglycerin stearate ester, polyglycerin oleate ester, polyglycerin behenate ester and the like; sorbitan esters such as sorbitan hexanoate ester, sorbitan octanoate ester, sorbitan decanoate ester, sorbitan laurate ester, sorbitan myristate ester, sorbitan palmitate ester, sorbitan stearate ester, sorbitan oleate ester, sorbitan behenate ester and the like; (poly) glycerin ethers such as (poly)glycerin monooctyl ether, (poly)glycerin monodecyl ether, (poly)glycerin monolauryl ether, (poly)glycerin monooleyl ether, (poly)glycerin monostearyl ether and the like; adducts of α-olefin oxides such as ethylene oxide, propylene oxide, dodecane-1,2-oxide and the like thereto. The amount of the component (D8) is preferably about 0.05 to 15% by weight based on the lubricating base.

The component (D9) is a inhibitor. Examples of the preservative include sulphonates listed in the examples of the metal detergent above, sodium nitrite, paraffin wax oxide calcium salts, paraffin wax oxide magnesium salts, beef tallow fatty acid alkali metal salts, alkali earth metal salts or amine salts, alkenyl succinates or alkenyl succinate half esters (alkenyl has a molecular weight of about 100 to 300), sorbitan monoesters, pentaerythritol monoesters, glycerin monoesters, nonylphenol ethoxylates, lanoline fatty acid esters, lanoline fatty acid calcium salts and the like. The amount of the component (D9) is preferably about 0.1 to 15% by weight based on the lubricating base.

The component (D10) is a viscosity index improver. Examples of the viscosity index improver include poly($C_1$ to $C_{18}$)alkyl methacrylates, ($C_1$ to $C_{18}$)alkyl acrylate/($C_1$ to $C_{18}$)alkyl methacrylate copolymers, diethylaminoethyl methacrylates/($C_1$ to $C_{18}$)alkyl methacrylate copolymers, ethylene/($C_1$ to $C_{18}$)alkyl methacrylate copolymers, polyisobutylenes, polyalkylstyrenes, ethylene/propylene copolymers, styrene/maleate ester copolymers, styrene/maleate amide copolymers, styrene/butadiene hydrogenated copolymers, styrene/isoprene hydrogenated copolymers and the like. An average molecular weight thereof is about 10,000 to 1,500,000. The amount of the component (D10) is preferably about 0.1 to 20% by weight based on the lubricating base.

The component (D11) is a metal inactivating agent. Examples of the metal inactivating agent include N,N'-salicylidene-1,2-propanediamine, alizarin, tetraalkylthiuram disulfide, benzotriazole, benzimidazole, 2-alkylbenzimidazole, 2-alkyldithiobenzothiazol, 2-(N,N-dialkyldithiocarbamoyl)benzothiazol, 2,5-bis(alkyldithio)-1,3,4-thiadiazol, 2,5-bis (N,N-dialkyldithiocarbamoyl)-1,3,4-thiadiazol and the like. An amount of the component (D11) is preferably about 0.01 to 5% by weight based on the lubricating base.

The component (D12) is a defoaming agent. Examples of the defoaming agent include polydimethylsilicone, trifluoropropylmethylsilicone, colloidal silica, polyalkylacrylates, polyalkylmethacrylates, alcoholethoxy/propoxylates, fatty acid ethoxy/propoxylates, sorbitan partial fatty acid esters and the like. The amount of the component (D12) is preferably about 0.001 to 1% by weight based on the lubricating base.

The component (D13) is a solid lubricant. Examples of the solid lubricant include graphite, molybdenum disulfide, polytetrafluoroethylenes, fatty acid alkali earth metal salts, mica, cadmium dichloride, cadmium diiodide, calcium fluoride, lead iodide, lead oxide, titanium carbide, titanium nitride, aluminum silicate, antimony oxide, cerium fluoride, polyethylene, diamond powder, silicon nitride, boron nitride, carbon fluoride, melamine isocyanurate and the like. The amount of the component (D13) is preferably about 0.005 to 2% by weight based on the lubricating base.

One or two or more of the components (D1) to (D13) can be blended in as required. When the lubricating composition of the present invention is used as a lubricating oil for an internal combustion engine, it is preferred that at least the metal detergent (D1) be blended therein. Since the molybdenum amine compound according to the present invention contains no sulfur atoms, it is preferred that the compound containing sulfur atoms be blended. For example, there is the compounds containing a sulfur atom and no metal atoms (D5), the compounds containing a phosphorus atom and a sulfur atom (D4), the compounds containing a sulfur atom among the organic metal compound (D7) such as dithiophosphoric acid metal salts, dithiocarbamic acid metal salts, mercaptobenzothiazole metal salts, mercaptobenzimidazole metal salts, benzamidothiophenol metal salts, molybdenum oxysulfide dithiocarbamate and molybdenum oxysulfide dithiophosphate.

The lubricating composition of the present invention comprises a lubricating base, the lubricant containing the molybdenum amine compound of the present invention, a zinc dithiophosphate as required, and various other additives.

Examples of the lubricating base for use in the present invention include a base oil comprising mineral oils, synthetic oils or a mixture thereof and a base grease obtained by mixing a thickener with such base oil. Otherwise, water is used when it is used as an aqueous lubricating oil.

When the lubricating composition of the present invention is used as a lubricating oil, the base oil has a dynamic viscosity of about 1 to 50 $mm^2/s$ at 100° C., about 10 to 1,000 $mm^2/s$ at 40° C., and a viscosity index (VI) of preferably 100 or more, more preferably 120 or more, most preferably 135 or more.

The mineral oils used as the base oil of the lubricating composition of the present invention are separated from natural crude oils and are produced by appropriately distilling and refining them. The mineral oils include hydrocarbons (mainly paraffin) as main components and also include monocyclic naphthenes, bicyclic naphthenes, aromatics and the like. These mineral oils may preferably be refined by hydrofinishing, solvent deasphalting, solvent extraction, solvent dewaxing, hydrodewaxing, contact dewaxing, hydrocracking, alkali distillation, sulfuric acid cleaning, clay treatment or the like. These refining measures can be used in combination as appropriate, and it is advantageous that the same procedure may be repeated in multiple stages.

For example, it is advantageous that the distillate is solvent-extracted or hydrogen-treated after solvent extraction, and then sulfuric acid cleaned (Process A), is dewaxed after hydrogen-treatment (Process B), is hydrogen-treated after solvent extraction (Process C), is clay treated after solvent extraction (Process D), is hydrogen-treated in two or three or more stages, or alkali distillated or sulfuric acid cleaned thereafter (Process E) and is hydrogen-treated, or alkali distilled or sulfuric acid cleaned after hydrogen-treatment (Process F) or that these treated distillates are mixed.

These treatments can remove aromatics, sulfur content, nitrogen content and the like in non-refined mineral oils. Although these impurities can be reduced to trace amounts thereof by current technology, about 3 to 5% by weight of aromatics may also be left since aromatics can make lubricant additives dissolve easily. For example, the sulfur content or nitrogen content of highly refined mineral oils is 0.01% by weight or less, or 0.005% by weight or less. In contrast, although there are cases where the aromatics content is 1% by weight or less, sometimes even 0.05% by weight or less, there are also cases where content is about 3% by weight.

The synthetic oil used as the base oil for use in the lubricating composition of the present invention is a chemically synthesized lubricant and includes poly-α-olefins, polyisobutylenes (polybutenes), diesters, polyolesters, aromatic polyhydric carboxylate esters, phosphate esters, silicate esters, polyalkylene glycols, polyphenyl ethers, silicones, fluorinated compounds, alkyl benzenes and the like. Specifically, poly-α-olefins, polyisobutylenes (polybutenes), diesters, polyolesters, polyalkylene glycols and the like can be universally used and preferably can be used for internal combustion engine oil or working oil.

Examples of the poly-α-olefins include polymers, oligomers or hydrogenated matters of 1-hexene, 1-octene, 1-nonene, 1-decene, 1-dodecene, 1-tetradecene and the like. Examples of the diesters include diesters of dibasic acids such as glutaric acid, adipic acid, azelaic acid, sebacic acid, dodecandioic acid and the like and alcohols such as 2-ethylhexanol, octanol, decanol, dodecanol, tridecanol and the like. Examples of the polyol esters include esters of polyols such as neopentylglycol, trimethylolethane, trimethylolpropane, glycerin, pentaerythritol, sorbitol, dipentaerythritol, tripentaerythritol, or alkylene oxide adducts thereof and the like, and fatty acids such as butyric acid, isobutyric acid, valerianic acid, isovalerianic acid, pivalic acid, capric acid, caproic acid, caprylic acid, lauric acid, myristic acid, palmytic acid, stearic acid, oleic acid and the like. Examples of the polyalkylene glycols include polyethylene glycols, polypropylene glycols, polyethylene glycol monomethyl ethers, mono- or dimethyl ethers of ethylene oxide/propylene oxide block or random copolymers and the like.

These synthetic oils are chemically synthesized and therefore are a single substance or a homogeneous mixture. The synthetic oils such as poly-α-olefins, polyisobutylenes (polybutenes), diesters, polyol-esters, polyalkylene glycols and the like do not contain impurities included in the mineral oils such as aromatic components such as benzene and condensed ring aromatic components, sulfur contents such as thiophene, or nitrogen contents such as indole and carbazole.

The base grease comprises the base oil and a thickener. Examples of the thickener include a soap-based or complex-based soap thickener, an organic non-soap-based thickener, and an inorganic non-soap-based thickener. Specific examples of the soap-based thickener include a reaction product of higher fatty acids such as lauric acid, myristic acid, palmitic acid, stearic acid, 12-hydroxystearic acid, arachic acid, behenic acid, zoomaric acid, oleic acid, linoleic acid, linolenic acid, and ricinoleic acid with a basic element such as aluminium, barium, calcium, lithium, sodium, and potassium; a complex soap thickener obtained by reacting the above higher fatty acid and the basic element with acetic acid, benzoic acid, sebacic acid, azelaic acid, phosphoric acid, and boric acid.

Examples of the organic non-soap-based thickener include a terephthalamate-based thickener, a urea-based thickener, a fluorine-based thickener such as polytetrafluoroethylene and a fluorinated ethylene-propylene copolymer. Preferred is a urea-based thickener.

Specific examples of the urea-based thickener include a monourea-based compound obtained by reacting a monoisocyanate with a monoamine, a diurea-based compound obtained by reacting a diisocyanate with a monoamine, a urea urethane-based compound obtained by reacting a diisocyanate with a monoamine and a monool, a tetraurea-based compound obtained by reacting a diisocyanate with a diamine and a monoisocyanate.

Examples of the monoisocyanate include methylisocyanate, ethylisocyanate, butylisocyanate, propylisocyanate, hexylisocyanate, octylisocyanate, laurylisocyanate, octadecylisocyanate, cyclohexylisocyanate, phenylisocyanate, tolyleneisocyanate and the like. Examples of the diisocyanate include hexamethylenediisocyanate, 2,4-tolylenediisocyanate, 2,6-tolylenediisocyanate, xylylenediisocyanate, diphenylmethane-4,4'-diisocyanate, 2,2'-dimethyldiphenylmethane-4,4'-diisocyanate, biphenyldiisocyanate, 3,3'-dimethylbiphenyldiisocyanate and the like.

Examples of the monoamine include octylamine, nonylamine, decylamine, laurylamine, tridecylamine, myristylamine, palmitylamine, stearylamine, oleylamine, phenylamine, tolylamine, cyclohexylamine. Examples of the diamine include ethylenediamine, propyrenediamine, hexamethylenediamine, octamethylenediamine, phenylenediamine, diaminodiphenyl methane and the like.

Examples of the monool include butanol, hexanol, 2-ethylhexanol, octanol, decanol, lauryl alcohol, tridecanol, myristyl alcohol, palmityl alcohol, stearyl alcohol, oleyl alcohol, phenol, cresol, cyclocresol and the like.

Examples of the inorganic non-soap-based thickener include montmorillonite, bentonite, silica aero gel, boron nitride and the like.

The thickener may be used alone or in combination of two or more thereof. A non-limiting amount of the thickener is preferably 3 to 40% by weight, more preferably 5 to 20% by weight based on the base grease comprising a base oil and a thickener. Typically, the base grease comprising the base oil and the thickener has non-limiting consistency of 100 to 500.

The content of alkali metals contained in the lubricating composition of the present invention is preferably 0.02% by weight or less, more preferably 0.01% by weight or less calculated in terms of the total amount of the alkali metals. The alkali metal may enter into the lubricating composition, when the alkali metal is used as a catalyst or a raw material and is not completely removed in a separation, a refining or a synthesizing step of the base oil. The alkali metal or its salts is often used as a raw material or catalyst in a synthesizing step of lubricant additives and may not be completely removed. During a molybdenum amine compound production, inorganics containing alkali metals are often used. Furthermore, sodium nitrite or sodium sulphonate may be used as an inhibitor, and alkali metal compounds may be added as a detergent or a dispersant.

The total nitrogen content of the lubricating composition of the present invention is preferably 0.01% by weight or more, more preferably 0.03% by weight or more and most preferably 0.05% by weight or more calculated in terms of the total amount of the nitrogen content. Nitrogen may enter into the lubricating composition, where the succinimide-based ashless dispersant, the molybdenum oxysulfide dithiocarbamate, the amine-based antioxidant, or fatty acid amide is used.

The lubricating composition of the present invention can be used for any lubricating application. For example, the lubricating composition herein is applicable to industrial lubricants, turbine oil, machine oil, bearing oil, compressor oil, hydraulic fluid, working fluid, internal combustion engine oil, refrigerator oil, gear oil, automatic transmission fluid (ATF), continuously variable transmission oil (CVTF), transaxle fluid, metal working fluid or the like. Also it is applicable to various greases for use in plain bearings, ball-and-roller bearings, gears, universal joints, torque limiters, automotive constant velocity joints (CVJ), ball joints, wheel bearings, constant velocity gears, transmission gears or the like.

EXAMPLES

The present invention will be illustrated by the following Examples, which are not in any way designed to limit its scope. All percentages are by weight unless otherwise specified.

Example 1

The lubricating compositions of the Examples and Comparative Examples were prepared using the base oils described below as the lubricating bases, the molybdenum amine compounds and sulfur containing compounds described below to evaluate the lubricity. Types and amounts (based on the base oils) of the molybdenum amine compounds and the sulfur containing compounds are shown in Table 1.

(1) Base oil:

(Base oil 1): Mineral oil-based oil having high VI
kinematic viscosity of
4.1 $mm^2/s$ (100° C.)
18.3 $mm^2/s$ )40° C.)
viscosity index (VI)=126

(Base oil 2): Synthetic oil comprising 80% of poly-α-olefin and 20% of polyolester obtained by oligomerizing 1-decene.
kinematic viscosity of
4.0 $mm^2/s$ (100° C.)
of 16.9 $mm^2/s$ (40° C.)
viscosity index (VI)=138

(Base oil 3): Mixed base oil where the base oils 1 and 2 are mixed in a ratio of 1:1.

(2) Molybdenum Amine Compound (MoAm):

(MoAm-1):

1 mole of molybdenum trioxide was dispersed in 540 ml of water under nitrogen flow, 2 moles of dioleylamine was added thereto dropwise for one hour while being maintained at 50 to 60° C., and the mixture was aged for one hour. Then, a water phase was separated and removed. A pale blue oily molybdenum amine compound (MoAm-1) was thus obtained.

(MoAm-2):

MoAm-2 was obtained by repeating the procedure for the preparation of MoAm-1 except that monoalkylamine having a plurality of alkyl groups with 14 to 18 carbon atoms was used instead of dioleylamine.

(MoAm-3):

MoAm-3 was obtained by repeating the procedure for the preparation of MoAm-1 except that dipentadecyl(C15) amine was used instead of dioleylamine.

(MoAm-4):

MoAm-4 was obtained by repeating the procedure for the preparation of MoAm-1 except that didococyl(C22)amine was used instead of dioleylamine.

(MoAm-5):

MoAm-5 was obtained by repeating the procedure for the preparation of MoAm-1 except that bis(2-hexyldecyl)amine was used instead of dioleylamine.

(MoAm-6):

MoAm-6 was obtained by repeating the procedure for the preparation of MoAm-1 except that N,N-dioleylmethylamine was used instead of dioleylamine.

(MoAm-7):

MoAm-7 was obtained by repeating the procedure for the preparation of MoAm-1 except that N-dodecylethanolamine was used instead of dioleylamine.

(MoAm-8):

MoAm-8 was obtained by repeating the procedure for the preparation of MoAm-1 except that N-oleyldiethanolamine was used instead of dioleylamine.

(MoAm-9):

MoAm-9 was obtained by repeating the procedure for the preparation of MoAm-1 except that N-2-hydroxytetradecylamine was used instead of dioleylamine.

(MoAm-10):

MoAm-10 was obtained by repeating the procedure for the preparation of MoAm-1 except that N-octadecyl-1,3-propanediamine was used instead of dioleylamine.

MoAm-1 to MoAm-10 are within the molybdenum amine compounds according to the present invention.

(MoAm-11):

MoAm-11 was obtained by repeating the procedure for the preparation of MoAm-1 except that dipropylamine was used instead of dioleylamine. MoAm-11 is a comparative sample.

(MoAm-12):

MoAm-12 was obtained by repeating the procedure for the preparation of MoAm-1 except that N,N-dibutylethanolamine was used instead of dioleylamine. MoAm-12 is a comparative sample.

(3) Sulfur Containing Compound:

(S compound-1):

Zinc dithiophosphate of the formula (3), wherein each of $R^5$ and $R^6$ is a 2-ethylhexyl group, the ratio of a neutral salt and a basic salt is 95/5.

(S compound-2):

Zinc dithiophosphate of the formula (3), wherein each of $R^5$ and $R^6$ is a dodecyl group, the ratio of a neutral salt and a basic salt is 95/5.

(S compound-3):

2,5-dioctyl-1,3,4-thiadiazol.

(4) Evaluation:

Mean friction coefficients and wear diameters of lubricating compositions E1 to E18 of the present invention and comparative lubricating compositions CE1 to CE5 (all new oils) were measured by using a SHELL type four-ball wear test machine with a load of 30 kg at room temperature and at 1500 rpm for 10 minutes. These lubricating compositions were oxidized to degraded oils at 165.5° C. for 24 hours at 1300 rpm in accordance with Japanese Industrial Standard JIS-K-2514 to measure mean friction coefficients and wear diameters thereof under the same conditions described above. The results are shown in Table 1.

TABLE 1

| | Base | MoAm | | S Compound | | Friction coefficient | | Wear diameter (mm) | |
|---|---|---|---|---|---|---|---|---|---|
| | oil | Type | (%) | Type | (%) | New oil | Degraded oil | New oil | Degraded oil |
| E1 | 1 | 1 | 1.0 | 1 | 2.0 | 0.14 | 0.15 | 0.38 | 0.44 |
| E2 | 1 | 2 | 1.0 | 1 | 2.0 | 0.14 | 0.15 | 0.39 | 0.45 |
| E3 | 1 | 3 | 1.0 | 1 | 2.0 | 0.14 | 0.15 | 0.40 | 0.44 |
| E4 | 1 | 4 | 1.0 | 1 | 2.0 | 0.14 | 0.15 | 0.41 | 0.42 |
| E5 | 1 | 5 | 1.0 | 1 | 2.0 | 0.14 | 0.15 | 0.41 | 0.43 |
| E6 | 1 | 6 | 1.0 | 1 | 2.0 | 0.14 | 0.15 | 0.44 | 0.49 |
| E7 | 1 | 7 | 1.0 | 1 | 2.0 | 0.14 | 0.15 | 0.45 | 0.49 |
| E8 | 1 | 8 | 1.0 | 1 | 2.0 | 0.14 | 0.15 | 0.44 | 0.48 |
| E9 | 1 | 9 | 1.0 | 1 | 2.0 | 0.14 | 0.15 | 0.45 | 0.48 |

TABLE 1-continued

| | Base | MoAm | | S Compound | | Friction coefficient | | Wear diameter (mm) | |
|---|---|---|---|---|---|---|---|---|---|
| | oil | Type | (%) | Type | (%) | New oil | Degraded oil | New oil | Degraded oil |
| E10 | 1 | 10 | 1.0 | 1 | 2.0 | 0.14 | 0.15 | 0.45 | 0.49 |
| E11 | 1 | 1 | 2.0 | 1 | 2.0 | 0.14 | 0.15 | 0.38 | 0.42 |
| E12 | 1 | 1 | 0.5 | 1 | 2.0 | 0.15 | 0.16 | 0.42 | 0.44 |
| E13 | 2 | 1 | 5.0 | 1 | 2.0 | 0.13 | 0.15 | 0.41 | 0.42 |
| E14 | 2 | 1 | 1.0 | 2 | 2.0 | 0.13 | 0.15 | 0.39 | 0.44 |
| E15 | 2 | 2 | 1.0 | 3 | 0.2 | 0.13 | 0.15 | 0.42 | 0.45 |
| E16 | 3 | 3 | 1.0 | 2 | 1.0 | 0.13 | 0.15 | 0.44 | 0.48 |
| E17 | 1 | 1 | 0.1 | 1 | 2.0 | 0.15 | 0.16 | 0.48 | 0.52 |
| E18 | 1 | 1 | 1.0 | 1 | 0.5 | 0.13 | 0.14 | 0.41 | 0.43 |
| | | | | 2 | 0.5 | | | | |
| CE1 | 1 | 11 | 1.0 | 2 | 2.0 | 0.13 | 0.17 | 0.42 | 0.80 |
| CE2 | 1 | 12 | 1.0 | 1 | 2.0 | 0.14 | 0.18 | 0.41 | 0.79 |
| CE3 | 2 | 12 | 1.0 | 2 | 2.0 | 0.13 | 0.18 | 0.43 | 0.81 |
| CE4 | 1 | 11 | 1.0 | — | — | 0.17 | 0.17 | 0.58 | 0.80 |
| CE5 | 1 | — | — | — | — | 0.18 | 0.18 | 0.53 | 0.80 |

Example 2

Grease compositions E1 to E15 of the present invention and comparative grease compositions CE1 to CE5 were prepared by mixing the following base greases as the lubricating base with the molybdenum amine compounds and the sulfur containing compounds to measure friction coefficients thereof. Types and amounts (based on the base greases) of the molybdenum amine compounds and the sulfur containing compounds are shown in Table 2.

(1) Base Grease (Base grease-1):

Base grease having a consistency of 300 at 25° C. in which an aliphatic amine-based urea compound is dispersed uniformly in refined mineral oil having a kinematic viscosity of 6 $mm^2/s$ at 100° C.

(Base grease-2):

Base grease having a consistency of 300 at 25° C. in which an aliphatic amine-based diurea compound is dispersed uniformly in polyol ester having a kinematic viscosity of 6 $mm^2/s$ at 100° C.

(2) Evaluation

Each of the grease compositions of the present invention and the comparative grease compositions was measured for a friction coefficient using an SRV tester with a point contact of a ball on a plate. The top ball had a diameter of 10 mm and the plate had a diameter of 24 mm and a thickness of 6.85 mm. The ball was set on the plate and vibrated reciprocatingly to determine the friction coefficient. Both the ball and the plate were made of SUJ-2. The details of the measurement conditions are as follows:

<Measurement conditions>

Load: 200N

Temperature: 90° C.

Measuring time: 2 hours

Amplitude: 1 mm

Cycle: 50 Hz

The results are shown in Table 2.

TABLE 2

| | Base | MoAm | | S Compound | | Friction |
|---|---|---|---|---|---|---|
| | grease | Type | (%) | Type | (%) | coefficient |
| E1 | 1 | 1 | 3.0 | 1 | 6.0 | 0.11 |
| E2 | 1 | 2 | 3.0 | 1 | 6.0 | 0.10 |
| E3 | 1 | 3 | 3.0 | 1 | 6.0 | 0.11 |
| E4 | 1 | 4 | 3.0 | 1 | 6.0 | 0.10 |
| E5 | 1 | 5 | 3.0 | 1 | 6.0 | 0.10 |
| E6 | 1 | 6 | 3.0 | 1 | 6.0 | 0.11 |
| E7 | 1 | 7 | 3.0 | 1 | 6.0 | 0.10 |
| E8 | 1 | 8 | 3.0 | 1 | 6.0 | 0.10 |
| E9 | 1 | 9 | 3.0 | 1 | 6.0 | 0.10 |
| E10 | 1 | 10 | 3.0 | 1 | 6.0 | 0.11 |
| E11 | 2 | 1 | 6.0 | 2 | 6.0 | 0.10 |
| E12 | 2 | 2 | 1.0 | 3 | 6.0 | 0.10 |
| E13 | 1 | 1 | 3.0 | 1 | 3.0 | 0.11 |
| E14 | 2 | 2 | 3.0 | 3 | 10.0 | 0.11 |
| E15 | 2 | 1 | 4.0 | 1 | 3.0 | 0.10 |
| | | | | 2 | 3.0 | |
| CE1 | 1 | 11 | 3.0 | 1 | 6.0 | 0.14 |
| CE2 | 1 | 12 | 3.0 | 1 | 6.0 | 0.15 |
| CE3 | 1 | 11 | 3.0 | — | — | 0.17 |
| CE4 | 2 | 12 | 3.0 | 2 | 6.0 | 0.14 |
| CE5 | 1 | — | — | — | — | 0.18 |

According to the present invention, there is provided a lubricant comprising a molybdenum amine compound having a relatively long chain hydrocarbon, and a lubricating composition containing the lubricant which exhibits excellent oxidation stability and which are usable for long periods of time.

What is claimed is:

1. A lubricant comprising a molybdenum amine compound obtained by reacting a compound containing a hexavalent molybdenum atom with an amine represented by the following formula (1):

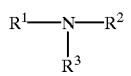

(1)

wherein each of $R^1$ to $R^3$ represents a hydrogen atom and/or a hydrocarbon group, and at least one of $R^1$ to $R^3$ is a chain hydrocarbon group having 14 or more carbon atoms, or the following formula (2)

(2)

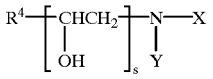

wherein $R^4$ represents a chain hydrocarbon group having 10 or more carbon atoms, s represents 0 or 1, X and/or Y represents a hydrogen atom, a hydrocarbon group having at least one carbon atom, an alkanol group having 2 to 4 carbon atoms or an alkyl amino group having at least one carbon atom, and both X and Y are not hydrogen atoms or hydrocarbon groups at the same time when s is 0.

2. A lubricant according to claim 1, wherein the compound containing the hexavalent molybdenum atom is a molybdenum trioxide or a hydrate thereof, molybdic acid, an alkali metal molybdate, or an ammonium molybdate.

3. A lubricating composition, comprising a lubricating base and the lubricant according to claim 1.

4. A lubricating composition according to claim 3, further comprising a zinc dithiophosphate represented by the following formula (3):

(3)

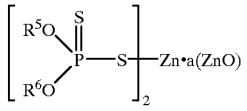

wherein each of $R^5$ and $R^6$ represents a hydrocarbon group, and a is 0 to 1/3.

5. A lubricating composition according to claim 3, further comprising a sulfur compound.

6. A lubricating composition according to claim 3, wherein the lubricating base is a base oil containing a mineral oil or a synthetic oil, or a base grease containing the base oil and a thickener.

* * * * *